US005243707A

United States Patent [19]

Bodinet

[11] Patent Number: 5,243,707

[45] Date of Patent: Sep. 14, 1993

[54] INFLATABLE HATS

[76] Inventor: Francis G. Bodinet, 17842 Tipton, Homewood, Ill. 60430

[21] Appl. No.: 872,230

[22] Filed: Apr. 22, 1992

[51] Int. Cl.[5] ..... A42B 1/04

[52] U.S. Cl. ..... 2/200.1; 2/DIG. 3; 2/DIG. 10; 2/171.02; 2/171

[58] Field of Search ..... 2/171, 200, 199, DIG. 3, 2/DIG. 11, 173.5, 175, 195, 411, 413, 417, 418, 419

[56] References Cited

U.S. PATENT DOCUMENTS

| | | | |
|---|---|---|---|
| 419,765 | 1/1890 | Frank | 2/DIG. 3 |
| 606,982 | 7/1898 | Smyth | 2/DIG. 10 |
| 1,221,473 | 4/1917 | Riley | 2/DIG. 10 |
| 1,426,402 | 8/1922 | Moore | 2/DIG. 3 |
| 1,560,073 | 11/1925 | Bontempi | 2/DIG. 3 |
| 2,593,188 | 4/1952 | Rikelman | 2/DIG. 10 |
| 2,632,176 | 3/1953 | Mitchell | 2/DIG. 3 |
| 3,009,162 | 11/1961 | Hori | 2/DIG. 3 |
| 3,029,438 | 4/1962 | Henschel | 2/200 |
| 3,951,160 | 4/1976 | Nitu | 2/DIG. 3 |
| 4,776,043 | 10/1988 | Coleman | 2/199 |
| 5,031,246 | 7/1991 | Kronenberger | 2/197 |

FOREIGN PATENT DOCUMENTS

| | | | |
|---|---|---|---|
| 2394260 | 2/1979 | France | 2/DIG. 10 |
| 7713575 | 6/1979 | Netherlands | 2/DIG. 3 |
| 1442193 | 7/1976 | United Kingdom | 2/DIG. 3 |

*Primary Examiner*—Clifford D. Crowder
*Assistant Examiner*—Diana L. Biefeld
*Attorney, Agent, or Firm*—Philip Hill

[57] ABSTRACT

An inflatable hat, preferably constructed of a metallized gas-impermeable polymeric sheet, may be provided in any of a number of novelty shapes, forms, colors, designs, and the like. Inexpensive construction affords adaptability to toys, advertising, sports promotions, and various theme objectives.

10 Claims, 3 Drawing Sheets

INFLATABLE HATS

BACKGROUND OF THE INVENTION

This invention relates to novelty decorated hats, adaptable, for example, to toys, games, advertising, and/or sport themes, which are inflatable.

Inflatable hats have been designed in the past generally to provide an inflatable and expandable dome section attached to a crown section, whereby the hat may be inflated and expanded to a selected degree. Such hats also generally provide for normal use, as in U. S. Pat. No. 2,593,188, when no enlargement is maintained. Electrical devices may also be attached to the crown section to provide a lighted dome section as desired. Similar designs for inflatable hats are illustrated in U. S. Pat. Nos. Des.278,381 and Des. 316,325.

Inexpensive novelty hats may be fabricated of pliable, yet substantially inelastic sheet materials that are inflatable to fill a predetermined form. Such hats may be provided in many shapes and sizes and may serve many purposes, ranging, for example, from play and amusement to thematic ventures to advertising promotions.

SUMMARY OF THE INVENTION

It is an object of this invention to provide novelty, inflatable hats which may be adorned with various colored designs, added decorations, and the like. Inflation preferably serves to expand the hat structure to that form defined by the shape of its original sheet fabrication materials. Such sheet materials are thin, flexible, and impermeable to gases, whereby the hat structure may be filled with gas to describe its extended form and to maintain this form for a substantial period of time with little or no leakage of the gas. In addition to the decorative designs which may be painted or printed on the sheet sections, added decorative items may be incorporated by fixation to the sheet sections, or by the design of the sheet sections. Such items may include animal heads, reptiles, birds, doll's heads, and various sports or advertising creations.

It is another object of this invention to provide a simplified means for construction, incorporating the crown of the hat structure into the expandable structure rather than attaching the latter to a separately formed crown.

It is a further object of this invention to provide the means for the simple, inexpensive manufacture of such novelty hats, whereby such hats may readily be utilized in children's programs, advertising programs, sports promotions, and the like.

Further objects will become apparent from the following description.

DESCRIPTION OF THE INVENTION

The inflatable hats of this invention are intended to provide a variety of types of decorative novelty creations for adaptation to themes related to toys, games , advertising, sports promotions, or other developments.

The hat structures of this invention generally conform to a selected two-dimensional , shaped, plastic material rendered three-dimensional by inflation with any desired gas to give the desired form to the structure. The structure is generally prepared from two or more thin, flat sheets of a flexible material that is impermeable to commonly available gases. Generally suitable and preferred sheet materials include polyesters, polyamides, polyolefins, polyacrylates, and the like. Mixtures of these may also be used. Plasticizing additives may also be incorporated as needed. Gases typically employed include air, nitrogen, carbon dioxide, helium or other generally inert gas, or mixtures thereof.

Figure 1:
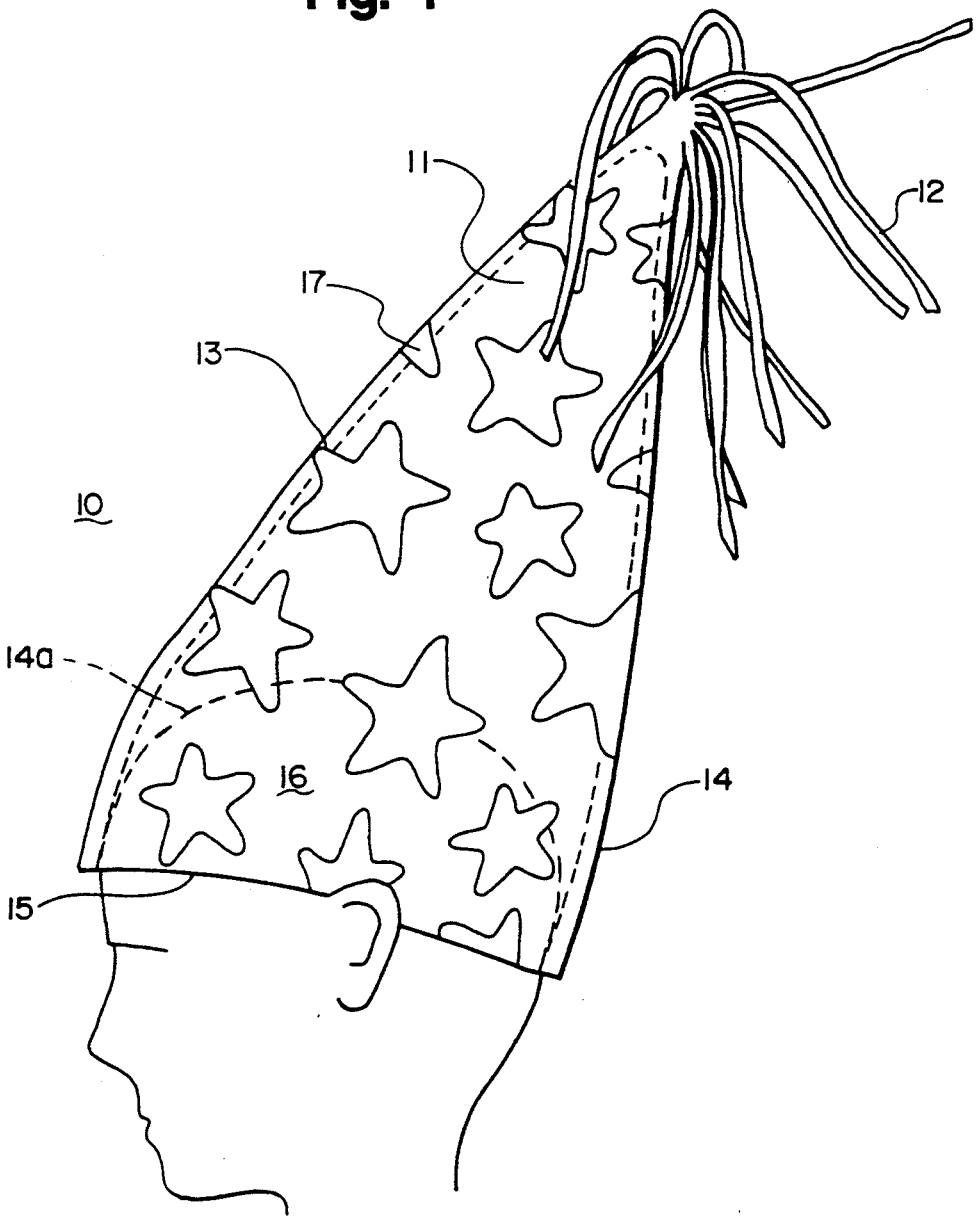
FIG. 1 is a side elevational view of one preferred embodiment of this invention.

In a generally preferred embodiment of this invention, two opposed sheete of a metallized polyester laminate are cut and heat-sealed as shown in FIG. 1 to afford inflatable hat 10. Laminated sheet 11 and its opposed counterpart, not shown, are cut to resemble a conical hat with selected external adornments 12 and printed FIGS. 13. The dotted line represents the heat seal 14 which extends upwardly along the exterior dimensions. Heat seal **14*a* describes a crown section which opens at the bottom dimension 15 to fit relatively snugly upon the user's head. The bottom dimension 15 of the laminated sheet may be rolled to provide added strength but, in any event, itis left open to describe the crown section 16 of the hat. A flexible inflation tube and valve 17 is provided either in the path of the external heat seal 14 or, if desired, in the crown heat seal 14*a***. The hat device may be inflated either prior to wearing or after the crown section is fitted to one's head.

Figure 2:
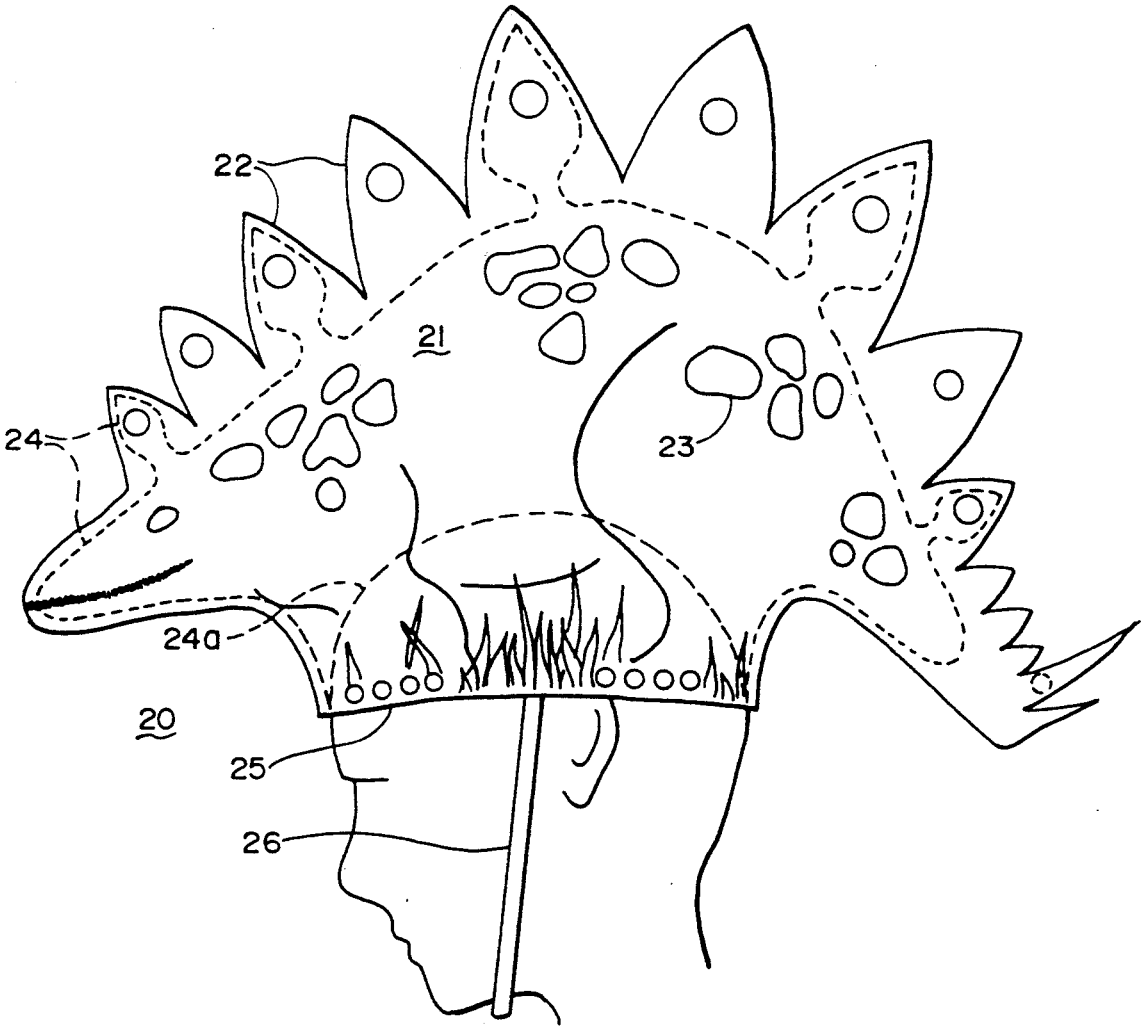
FIGS. 2 and 3 are side elevational views of embodiments of this invention which embrace, respectively, reptile and animal decorations.

Another preferred embodiment is set forth in FIG. 2, illustrating an inflatable reptile hat 20. Laminated sheet 21 and its counterpart, not shown, represent a reptile FIG. as a head cover, having exterior fins 22 and printed FIGS. 23. In this instance heat seal 24 includes only portions of the fin sections of the external dimensions, leaving the others to wave in the breeze, hang loosely, or otherwise adorn the reptilian device. As before, the heat seal **24*a* describes the crown section. The bottom dimension 25 is fitted with chin strap 26**. An inflation tube may be inserted at any entry point, not shown, along the course of the heat seals.

Figure 3:
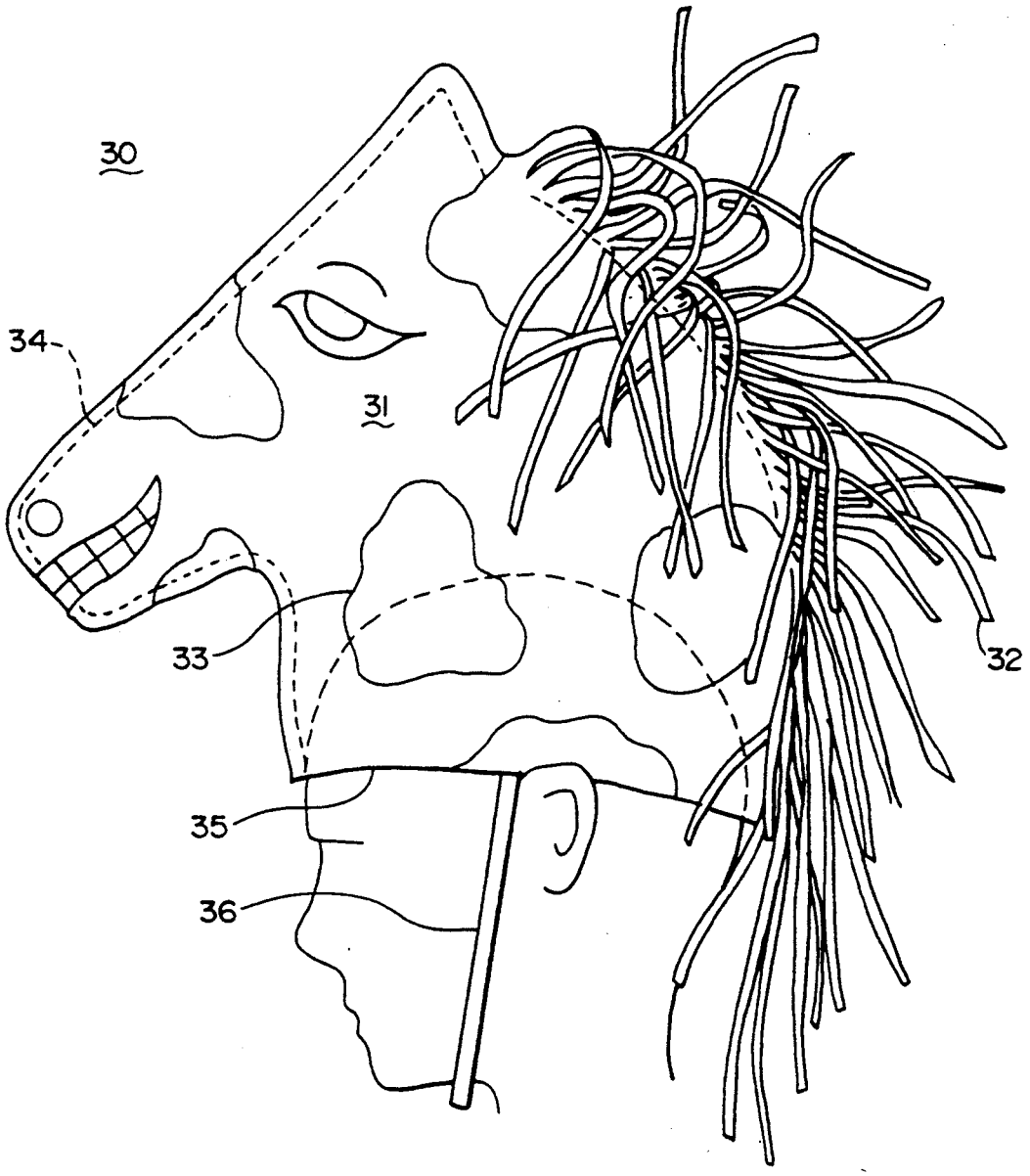

Similar to the embodiment illustrated in FIG. 2 is that of an inflatable animal head hat 30 as shown in FIG. 3. In this instance, laminated sheet 31 and its counterpart, not shown, represent a horse head as a head cover, having a mane 32 and spots 33. As in FIG. 1, heat seal 34 extends along the entire outer dimension while heat seal **34*a* describes a crown section. As in FIG. 2, the bottom dimension 35 is fitted with chin strap 36**. As before, the inflation tube entry may be provided at any preferred entry point along the course of the heat seal.

The invention of this disclosure thus provides a unique but simple arrangement whereby an inflatable hat, when inflated conventionally, affords a variety of structures,useful in toys, games, travel or activity themes, or selected types of promotions generally.

Variations of the described embodiments permit the use of: other materials , such as rubber-coated paper; headbands placed within the shaped crown section or the insertion of a cap unit therein, as desired; silk-screen techniques for painting decorations and designs on the flexible sheeting; and other techniques or variations brought to mind by one skilled in the art.

I claim:

1. A head cover, inflatable to describe a novelty shape or design, comprising:

a) at least two shaped hat sections, each hat section being sealed to another along vertically-inclined side edges and a top edge thereof, and having an open bottom edge;

b) a shaped crown section adjacent the bottom edge, described by a seal running across the shaped hat sections and continuous with the sealed side and top edges; and c) inflation means attached to said head cover; whereby the sealed portions describe a hat that may be inflated to provide a head-fitting novelty hat.

2. The head cover of claim 1 wherein the inflation means comprises a flexible tube and valve assembly inserted in the seal of one of the shaped hat sections.

3. The head cover of claim 1 wherein the inflation means comprises a flexible tube and valve assembly inserted in the seal of the shaped crown section.

4. The head cover of claim 1 wherein the shaped crown section is additionally fitted with a head band.

5. The head cover of claim 1 wherein the shaped crown section is additionally fitted with a chin strap.

6. The head cover of claim 1 wherein the hat sections and crown section are constructed of a flexible, gas-impermeable sheet material.

7. The head cover of claim 6 wherein the flexible, gas-impermeable sheet material is selected from the class consisting of polyesters, polyamides, polyolefins, polyacrylates, and blends thereof.

8. The head cover of claim 6 wherein the selected flexible, gas-impermeable sheet material is metallized by coating or lamination.

9.The head cover of claim 1 wherein one or more of the shaped hat sections is decorated with colors, designs, and the like.

10. The head cover of claim 1 wherein one or more of the shaped hat sections additionally include external decorated sections affixed thereto.

* * * * *